US011217202B2

(12) United States Patent
He et al.

(10) Patent No.: US 11,217,202 B2
(45) Date of Patent: Jan. 4, 2022

(54) METHOD AND APPARATUS FOR CONVERTING RGB IMAGE SIGNAL INTO RGBW IMAGE SIGNAL

(71) Applicants: Hefei Xinsheng Optoelectronics Technology Co., Ltd., Anhui (CN); BOE TECHNOLOGY GROUP CO., LTD., Beijing (CN)

(72) Inventors: Min He, Beijing (CN); Chun Cao, Beijing (CN); Wenchao Bao, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 149 days.

(21) Appl. No.: 16/609,429

(22) PCT Filed: Mar. 28, 2019

(86) PCT No.: PCT/CN2019/079987
§ 371 (c)(1),
(2) Date: Oct. 29, 2019

(87) PCT Pub. No.: WO2019/192374
PCT Pub. Date: Oct. 10, 2019

(65) Prior Publication Data

US 2020/0058265 A1 Feb. 20, 2020

(30) Foreign Application Priority Data

Apr. 3, 2018 (CN) ..... 201810289273.0

(51) Int. Cl.
*G09G 5/02* (2006.01)
*G09G 5/10* (2006.01)

(52) U.S. Cl.
CPC ..... *G09G 5/02* (2013.01); *G09G 5/10* (2013.01); *G09G 2320/045* (2013.01); *G09G 2340/06* (2013.01)

(58) Field of Classification Search
None
See application file for complete search history.

(56) References Cited

U.S. PATENT DOCUMENTS

2018/0040284 A1* 2/2018 Kang ..... H04N 9/646
2018/0277049 A1* 9/2018 Pan ..... G09G 3/2074

* cited by examiner

*Primary Examiner* — Aaron M Richer
(74) *Attorney, Agent, or Firm* — Myers Bigel, P.A.

(57) ABSTRACT

The present disclosure relates to a method for converting RGB image signals into RGBW image signals. The method includes converting RGB image signals of pixels of each received image frame into corresponding RGB luminance values respectively, performing a conversion from an RGB luminance value to an RGBW luminance value for each pixel, including performing a first conversion to the RGBW luminance value by determining a first conversion amount based on the corresponding RGB luminance value of the pixel to obtain a first RGBW luminance value of the pixel, performing a second conversion to the RGBW luminance value by determining a second conversion amount based on the first RGBW luminance values of the pixel and its adjacent one or more pixels to obtain a second RGBW luminance value of the pixel, and converting the second RGBW luminance values of the pixels of the image frame into corresponding RGBW image signals respectively.

20 Claims, 3 Drawing Sheets

| | | |
|---|---|---|
| F | B | G |
| C | A | D |
| H | E | I |
FIG. 2d
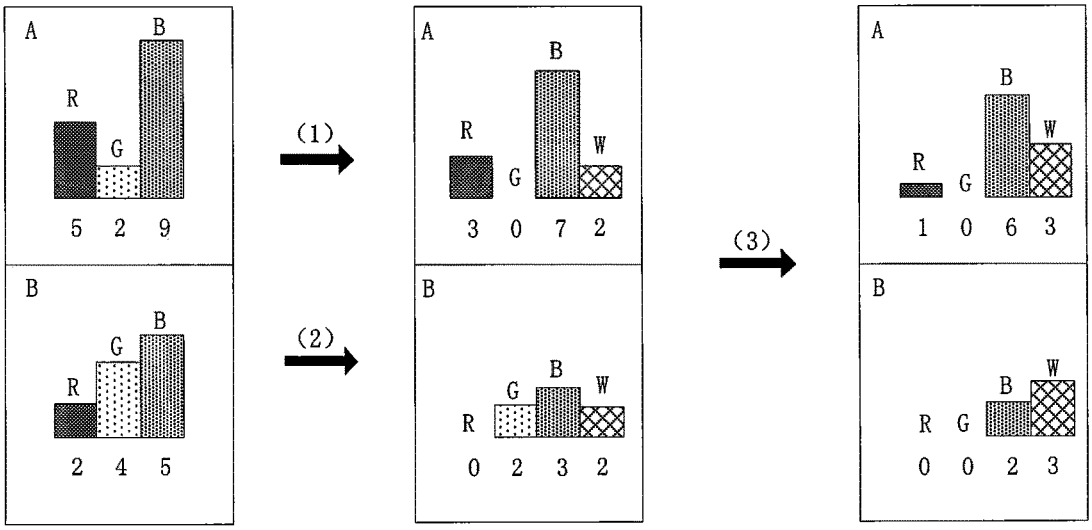
FIG. 3
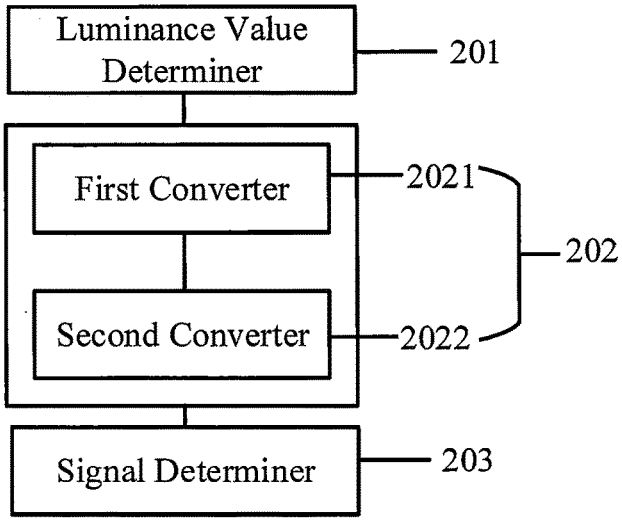
FIG. 4

METHOD AND APPARATUS FOR CONVERTING RGB IMAGE SIGNAL INTO RGBW IMAGE SIGNAL

CROSS REFERENCE TO RELATED APPLICATIONS

The present application is the U.S. national phase entry of PCT/CN2019/079987, with an international filling date of Mar. 28, 2019, which claims the benefit of Chinese Patent Application No. 201810289273.0, filed on Apr. 3, 2018, the entire disclosures of which are incorporated herein by reference.

FIELD

The present disclosure relates to the field of display technologies, and particularly to a method and apparatus for converting RGB image signals into RGBW image signals.

BACKGROUND

At present, in the field of display technologies, for example, in an image display device of a liquid crystal display (LCD) and an organic light emitting diode (OLED), a pixel unit is formed of a red (R) sub-pixel, a green (G) sub-pixel and a blue (B) sub-pixel, and a color image is displayed by controlling a grayscale value of each sub-pixel unit so as to reproduce a color to be displayed through mixing.

However, during the use of a display device, each sub-pixel gradually ages under the influence of working time and working intensity. Aging of sub-pixels (particularly blue sub-pixels) may limit the display effect and lifetime of the display device. Therefore, how to slow down the aging of each sub-pixel is a technical problem to be solved urgently.

SUMMARY

In a first aspect, embodiments of the present disclosure provide a method for converting RGB image signals into RGBW image signals. The method comprises: converting RGB image signals of pixels of each received image frame into corresponding RGB luminance values respectively; performing a conversion from an RGB luminance value to an RGBW luminance value for each pixel, which comprises: performing a first conversion to the RGBW luminance value by determining a first conversion amount based on the corresponding RGB luminance value of the pixel to obtain a first RGBW luminance value of the pixel, and performing a second conversion to the RGBW luminance value by determining a second conversion amount based on the first RGBW luminance values of the pixel and its adjacent one or more pixels to obtain a second RGBW luminance value of the pixel; and converting the second RGBW luminance values of the pixels of each image frame into corresponding RGBW image signals respectively.

Optionally, the first conversion comprises: subtracting the first conversion amount respectively from an R luminance value, a G luminance value and a B luminance value of the corresponding RGB luminance value of the pixel, and taking the first conversion amount as a W luminance value, to obtain the first RGBW luminance value of the pixel. The first conversion amount is determined as a minimum value among the R luminance value, the G luminance value and the B luminance value of the RGB luminance value, and the second conversion comprises: grouping the pixel and its adjacent pixel(s) into a group including N pixels, subtracting, from the R luminance values, G luminance values and B luminance values of the first RGBW luminance values of pixels in the group, corresponding conversion amounts determined according to the second conversion amount respectively, so that the second conversion amount is subtracted respectively from a sum of the R luminance values, a sum of the G luminance values and a sum of the B luminance values of the first RGBW luminance values of the N pixels, and a ratio of the second conversion amount to N is added to the W luminance values, to obtain the second RGBW luminance values of respective pixels; the second conversion amount is not greater than a minimum value among the sum of the R luminance values, the sum of the G luminance values and the sum of the B luminance values of the first RGBW luminance values of the N pixels; here $N \geq 2$.

Optionally, the second conversion is not performed when at least one of the sum of the R luminance values, the sum of the G luminance values and the sum of the B luminance values of the first RGBW luminance values of the N pixels is zero.

Optionally, the corresponding conversion amounts are determined by: when, among the N pixels, the number of pixels that each has a non-zero R luminance value in a respective first RGBW luminance value is $n_R$, a corresponding conversion amount subtracted from an R luminance value is $1/n_R$ of the second conversion amount, where $n_R \leq N$; when, among the N pixels, the number of pixels that each has a non-zero G luminance value in a respective first RGBW luminance value is $n_G$, a corresponding conversion amount subtracted from a G luminance value is $1/n_G$ of the second conversion amount, where $n_G \leq N$; and when, among the N pixels, the number of pixels that each has a non-zero B luminance value in a respective first RGBW luminance value is $n_B$, a corresponding conversion amount subtracted from a B luminance value is $1/n_B$ of the second conversion amount, where $n_B \leq N$.

Optionally, the N pixels are determined by: when N=2, the N pixels comprise the pixel and a pixel closest to the pixel in a row direction or a column direction; when N=5, the N pixels comprise the pixel and four pixels closest to the pixel in a row direction and a column direction; when N=9, the N pixels comprise the pixel, four pixels closest to the pixel in a row direction and a column direction, and four pixels closest to the pixel in a diagonal direction.

Optionally, the second conversion comprises: performing the second conversion once when the second conversion amount is equal to a minimum value among the sum of R luminance values, the sum of G luminance values and the sum of B luminance values among the first RGBW luminance values of respective ones of the N pixels; performing the second conversion at least twice when the second conversion amount is smaller than a minimum value among the sum of R luminance values, the sum of G luminance values and the sum of B luminance values among the first RGBW luminance values of each of the N pixels, until an obtained minimum value among the sum of the R luminance values, the sum of the G luminance values and the sum of the B luminance values of the second RGBW luminance values of the N pixels is zero.

In a second aspect, embodiments of the present disclosure provide an apparatus for converting RGB image signals into RGBW image signals. The apparatus comprises a luminance value determiner, a converter unit and a signal determiner. The luminance value determiner is configured to convert RGB image signals of pixels of each received image frame into corresponding RGB luminance values respectively. The converter unit is configured to perform a conversion from an RGB luminance value to an RGBW image signal for each pixel, and comprises: a first converter configured to perform a first conversion to an RGBW luminance value by determining a first conversion amount based on a corresponding RGB luminance value of the pixel to obtain a first RGBW luminance value of the pixel; and a second converter configured to perform a second conversion to the RGBW luminance value by determining a second conversion amount based on the first RGBW luminance values of the pixel and its adjacent one or more pixels to obtain a second RGBW luminance value of the pixel. The signal determiner is configured to convert the second RGBW luminance values of the pixels of each image frame into corresponding RGBW image signals respectively.

Optionally, the first converter is configured to subtract the first conversion amount respectively from an R luminance value, a G luminance value and a B luminance value of the RGB luminance value of the pixel, and take the first conversion amount as a W luminance value, in order to obtain the first RGBW luminance value of the pixel. The first conversion amount is a minimum value among the R luminance value, the G luminance value and the B luminance value of the RGB luminance value. The second converter is configured to: group the pixel and its adjacent pixels into a group including N pixels, subtract corresponding conversion amounts determined according to the second conversion amount respectively from the R luminance values, G luminance values and B luminance values of the first RGBW luminance values of respective pixels in the group, so that the second conversion amount is subtracted respectively from a sum of the R luminance values, a sum of the G luminance values and a sum of the B luminance values of the first RGBW luminance values of the N pixels, and a ratio of the second conversion amount to N is added to the W luminance values, to obtain the second RGBW luminance values of the respective pixels; the second conversion amount is not greater than a minimum value among the sum of the R luminance values, the sum of the G luminance values and the sum of the B luminance values of the first RGBW luminance values of the N pixels; here $N \geq 2$.

Optionally, the second converter is configured not to perform the second conversion when at least one of the sum of the R luminance values, the sum of the G luminance values and the sum of the B luminance values of the first RGBW luminance values of the N pixels is zero.

Optionally, the second converter is configured to determine the corresponding conversion amounts by: when, among the N pixels, the number of pixels that each has a non-zero R luminance value in a respective first RGBW luminance value is $n_R$, a corresponding conversion amount subtracted from an R luminance value is $1/n_R$ of the second conversion amount, where $n_R \leq N$; when, among the N pixels, the number of pixels that each has a non-zero G luminance value in a respective first RGBW luminance value is $n_G$, a corresponding conversion amount subtracted from a G luminance value is $1/n_G$ of the second conversion amount, where $n_G \leq N$; and when, among the N pixels, the number of pixels that each has a non-zero B luminance value in a respective first RGBW luminance value is $n_B$, a corresponding conversion amount subtracted from a B luminance value is $1/n_B$ of the second conversion amount, where $n_B \leq N$.

Optionally, the second converter is configured to determine the N pixels by: when N=2, the N pixels comprise the pixel and a pixel closest to the pixel in a row direction or a column direction; when N=5, the N pixels comprise the pixel and four pixels closest to the pixel in a row direction and a column direction; when N=9, the N pixels comprise the pixel, four pixels closest to the pixel in a row direction and a column direction, and four pixels closest to the pixel in a diagonal direction.

Optionally, the second converter is configured to perform the second conversion once when the second conversion amount is equal to a minimum value among the sum of R luminance values, the sum of G luminance values and the sum of B luminance values of the first RGBW luminance values of respective ones of the N pixels; perform the second conversion at least twice when the second conversion amount is smaller than a minimum value among the sum of R luminance values, the sum of G luminance values and the sum of B luminance values among the first RGBW luminance values of each of the N pixels, until an obtained minimum value among the sum of the R luminance values, the sum of the G luminance values and the sum of the B luminance values of the second RGBW luminance values of the N pixels is zero.

In a third aspect, embodiments of the present disclosure provide a computing device. The computing device comprises: one or more processors; and a computer readable storage medium having stored thereon a plurality of instructions which, responsive to being executed by the one or more processors, cause the one or more processors to perform the above method.

BRIEF DESCRIPTION OF THE DRAWINGS

To the accomplishment of the foregoing and related ends, the following description and accompanying drawings set forth certain illustrative aspects and implementations. These are indicative of but a few of the various ways in which one or more aspects may be employed. Other aspects, advantages, and novel features of the disclosure will become apparent from the following detailed description when considered in conjunction with the accompanying drawings.

FIG. 2*a* through FIG. 2*d* are schematic diagrams illustrating layouts of adjacent N pixels according to embodiments of the present disclosure;

FIG. 3 is a schematic diagram of an effect achieved after performing a first conversion and a second conversion for an RGB image signal according to an embodiment of the present disclosure;

FIG. 4 is a schematic structural diagram of an apparatus according to an embodiment of the present disclosure.

DETAILED DESCRIPTION

In the following description, certain specific details of the disclosed embodiment such as architecture, interfaces and techniques, etc., are set forth for purposes of explanation rather than limitation, so as to provide a clear and thorough understanding of the present disclosure. However, it should be understood readily by those skilled in this art, that the present disclosure may be practiced in other embodiments which do not conform exactly to the details set forth herein, without departing significantly from the spirit and scope of this disclosure. Further, in this context, and for the purpose of brevity and clarity, detailed descriptions of well-known apparatus, circuits and methodology have been omitted so as to avoid unnecessary detail and possible confusion.

Embodiments of the present disclosure provide a method and apparatus for converting RGB image signals into RGBW image signals, to address a problem in the prior art that the aging of sub-pixels in a display panel affects the display effect and the service life. According to approaches of the embodiments of the present disclosure, after performing an RGBW sub-pixel replacement algorithm based on RGB values of a current pixel itself, the RGBW pixel replacement algorithm is performed again by taking the RGBW luminance values of one or more pixels adjacent to the current pixel, thereby further reducing a probability of lighting sub-pixels (R/G/B/W) with high grayscale. At the same time, the approaches of the embodiments of the present disclosure may still ensure a picture display effect by utilizing a characteristic of human eyes that superimposes pixels in a picture as a whole. In this way, the aging of the sub-pixels is slowed down, and the service life of the display panel is prolonged.

Figure 1:
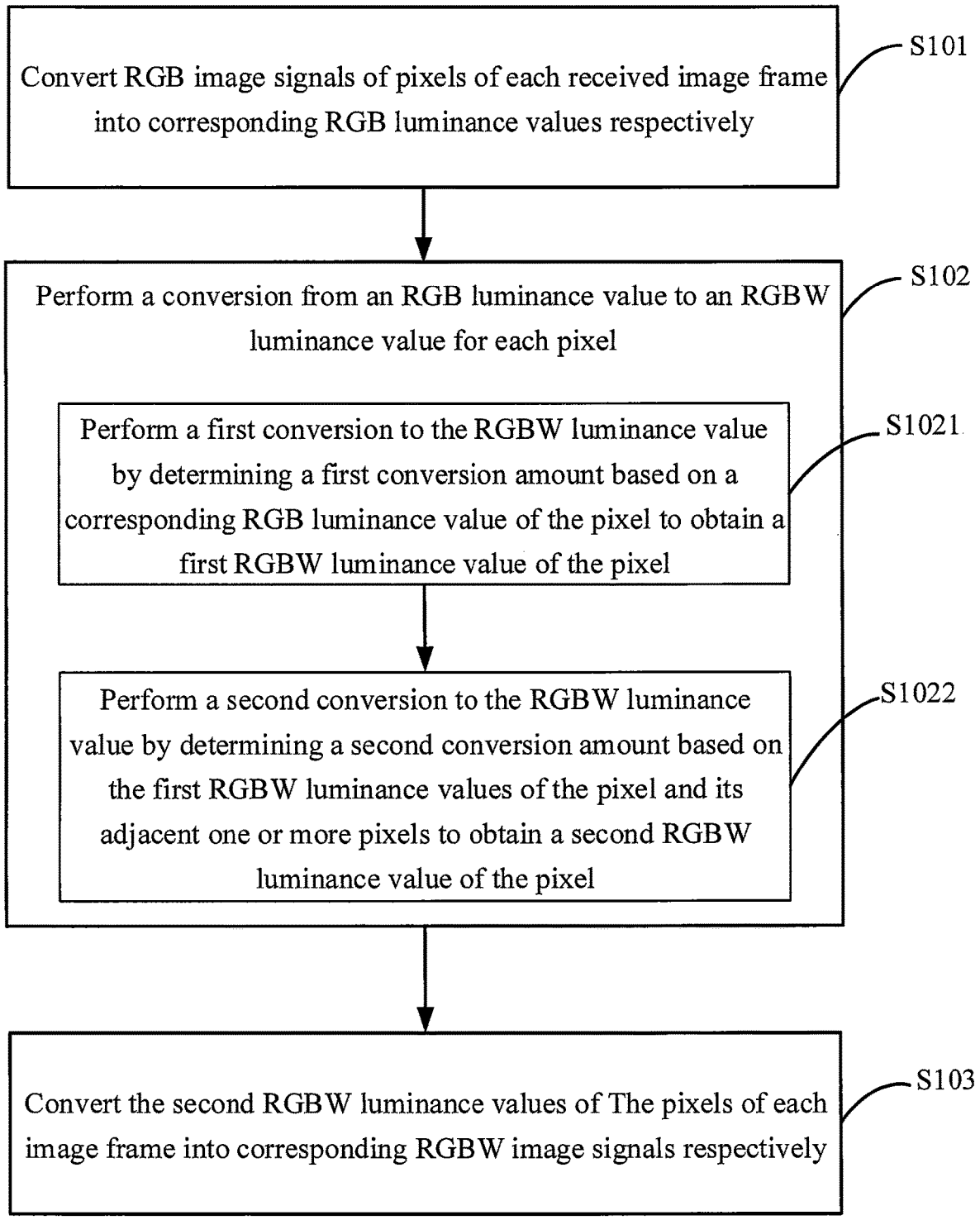
FIG. 1 is a flowchart of a method according to an embodiment of the present disclosure.

FIG. 1 schematically illustrates an embodiment of a method of converting RGB image signals into RGBW image signals according to the present disclosure, the method comprising the following steps.

At step S101, RGB image signals of pixels of each received image frame are converted into corresponding RGB luminance values respectively. In some embodiments, an RGB image signal may be converted to a corresponding RGB luminance value through gamma conversion so as to subsequent convert the RGB luminance value.

At step S102, conversion from an RGB luminance value to an RGBW luminance value is performed for each pixel. Step 102 comprises step S1021 and step S1022.

At step S1021, a first conversion to the RGBW luminance value is performed by determining a first conversion amount based on the corresponding RGB luminance value of the pixel to obtain a first RGBW luminance value of the pixel.

In some embodiments, the first conversion may comprise: subtracting the first conversion amount respectively from an R luminance value, a G luminance value and a B luminance value of the RGB luminance value, and taking the first conversion amount as a W luminance value, in order to obtain the first RGBW luminance value. The first conversion amount may be determined as a minimum value among the R luminance value, the G luminance value and the B luminance value of the RGB luminance value.

At step S1022, a second conversion to the RGBW luminance value is performed by determining a second conversion amount based on the first RGBW luminance values of the pixel and its adjacent one or more pixels to obtain a second RGBW luminance value of the pixel.

In some embodiments, the second conversion may comprise: grouping the pixel and its adjacent pixels into a group including N pixels, subtracting a corresponding conversion amount(s) determined according to the second conversion amount respectively from the R luminance values, G luminance values and B luminance values of the first RGBW luminance values of respective pixels in the group, so that the second conversion amount is subtracted respectively from a sum of the R luminance values, a sum of the G luminance values and a sum of the B luminance values of the first RGBW luminance values of the N pixels, and a ratio of the second conversion amount to N is added to the W luminance values, to obtain the second RGBW luminance values of the respective pixels. The second conversion amount is not greater than a minimum value among the sum of the R luminance values, the sum of the G luminance values and the sum of the B luminance values of the first RGBW luminance values of the respective pixel in the N pixels; $N \geq 2$. Here, subtracting the second conversion amount from the sum of R luminance values of the first RGBW luminance values of the N pixels means that a sum of the corresponding conversion amounts subtracted from respective R luminance values of respective first RGBW luminance values of the N pixels is equal to the second conversion amount. Likewise, subtracting the second conversion amount from the sum of the G luminance values means that a sum of the corresponding conversion amounts subtracted from respective G luminance values is equal to the second conversion amount, and subtracting the second conversion amount from the sum of the B luminance values means that a sum of the corresponding conversion amounts subtracted from respective B luminance values is equal to the second conversion amount.

At step S103, the second RGBW luminance values of respective pixels of each image frame are converted into corresponding RGBW image signals.

According to an embodiment of the present disclosure, in a conversion from an RGB luminance value to the RGBW luminance value, each pixel of each image frame is considered together with its neighboring pixels as a whole in order to finally achieve conversion to an RGBW image signal. The RGBW image signals are used to drive a display panel having an RGBW pixel structure to display an image frame.

The method of converting an RGB image signal into an RGBW image signal according to an embodiment of the present disclosure may be applied to various color display panels or displays, including, but not limited to, a liquid crystal display panel or a self-luminous display panel such as an organic electroluminescence display panel or the like. In some embodiments, the method according to embodiments of the present disclosure may be performed by a display driver or processor in a display.

Optionally, when the first conversion from the RGB luminance value to the RGBW luminance value is performed for a pixel, a minimum value in the R luminance value, the G luminance value and the B luminance value of the RGB luminance value of the pixel may be first determined, thereby determining the first conversion amount. In some embodiments, the first conversion amount may be equal to or less than the minimum value. Then, the first conversion amount is subtracted respectively from the R luminance value, the G luminance value and the B luminance value, to obtain an R luminance value, a G luminance value and a B luminance value of the first RGBW luminance value, and the first conversion amount is taken as a W luminance value of the first RGBW luminance value, thereby forming the first RGBW luminance value.

For example, let the RGB luminance value of pixel A be: $A=(x1R, y1G, z1B)$, that is, the R luminance value is x1, the G luminance value is y1, the B luminance value is z1, and $k1=\min(X1, y1, z1)$. Then, the RGBW luminance value of the pixel A obtained after the first conversion is: $A=[(x1-k1)R, (y1-k1)G, (z1-k1)B, k1W]$.

That is, the first conversion amount in the R luminance value, the first conversion amount in the G luminance value and the first conversion amount in the B luminance value are replaced with a W luminance value of the first conversion amount. Since the W luminance value equivalently replaces the R, G, and B luminance values, the R, G, and B luminance values are lowered, thereby reducing the grayscale value input when the display panel is lighted up. This alleviates the aging of the sub-pixels and prolongs the service life of the display panel. At the same time, since conversions from R, G, and B luminance values to the W luminance value are equivalent conversion, no impact is caused to the display effect of the display panel based on a characteristic of human eyes that superimposes pixels in overall picture.

Optionally, when the second conversion from the RGB luminance value to the RGBW luminance value is performed for a pixel, adjacent pixels of the pixel to be considered in the second conversion may be selected in different manners. FIG. 2*a* through FIG. 2*d* are schematic diagrams illustrating the layouts of adjacent N pixels (N≥2) according to embodiments of the present disclosure.

Figure 2A:
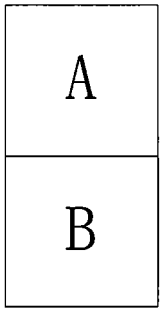

FIG. 2*a* shows that when the current pixel is A and N=2, the pixel B closest to the pixel A in the row direction may be determined as the adjacent pixel of the pixel A. The first RGBW luminance values of pixels A and B are used for the second conversion.

Figure 2B:
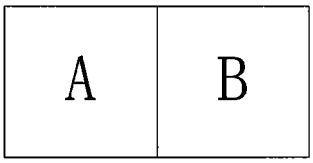

FIG. 2*b* shows that when the current pixel is A and N=2, the pixel B closest to the pixel A in the column direction may be determined as the adjacent pixel of the pixel A. The first RGBW luminance values of pixels A and B are used for the second conversion.

Figure 2C:
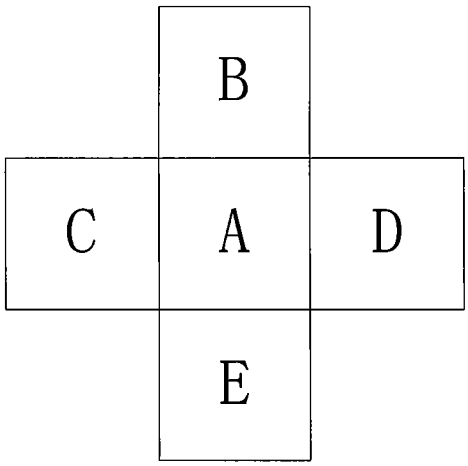

FIG. 2*c* shows that when the current pixel is A and N=5, four pixels closest to the pixel A in the row direction and the column direction (that is, pixels B and E closest to the pixel A in the column direction, and pixels C and D closest to the pixel A in the row direction) may be determined as adjacent pixels of the pixel A. The first RGBW luminance values of pixels A, B, C, D and E are used for the second conversion.

FIG. 2*d* shows that when the current pixel is A and N=9, four pixels closest to the pixel A in the row direction and the column direction (that is, pixels B and E closest to the pixel A in the column direction, and pixels C and D closest to the pixel A in the row direction) and four pixels closest to the pixel in a diagonal direction (namely, pixels F, D, H and I) may be determined as adjacent pixels of the pixel A. The first RGBW luminance values of pixels A, B, C, D, E, F, G, H and I are used for the second conversion.

It may be understood that the layout of the pixels and the value of N are only by way of example. In some other embodiments, other patterns may be employed for the layout of the pixels, and N may be determined to be other values as appropriate, without being limited thereto.

In an embodiment, upon the first conversion, the first RGBW luminance value may be determined by the following equations:

$$Li=[(Xi-Ki)R,(Yi-Ki)G,(Zi-Ki)B,KiW];$$

$$Ki=\min(Xi,Yi,Zi);$$

where i denotes the $i^{th}$ pixel, Li denotes the first RGBW luminance value of the pixel, Ki denotes the first conversion amount, Xi denotes the R luminance value of the RGB luminance value of the pixel, Yi denotes the G luminance value of the RGB luminance value of the pixel, and Zi represents the B luminance value of the RGB luminance value of the pixel.

In an exemplary scenario where N=2, assume that the current pixel is A, its adjacent pixel is B, and the RGB luminance value of pixel A is (X1R, Y1G, Z1B), and the RGB luminance value of pixel B is (X2R, Y2G, Z2B).

After the first conversion, the first RGBW luminance value of pixel A may be:

$$L1=[(X1-K1)R,(Y1-K1)G,(Z1-K1)B,K1W],$$

and the first RGBW luminance value of pixel B is:

$$L2=[(X2-K2)R,(Y2-K2)G,(Z2-K2)B,K2W].$$

According to an embodiment of the present disclosure, if $[(X1-K1)+(X2-K2)]*[(Y1-K1)+(Y2-K2)]*[(Z1-K1)+(Z2-K2)]\neq 0$, that is, the R luminance value, the G luminance value or the B luminance value of the pixel A and the pixel B after the first conversion are not zero at the same time, the second conversion may be subsequently performed based on the first RGBW luminance values of the pixel A and pixel B.

Since in the first conversion, the first conversion amount may be determined as the minimum value among the R luminance value, the G luminance value and the B luminance value, at least one luminance value equal to zero exists in the R, G, and B luminance values after the first conversion. Taking (Y1−K1)=0, (X2−K2)=0 as an example, the second conversion amount for the second conversion may be determined according to the following equation, that is, the second conversion amount K=min((X1−K1), (Z1−K1), (Y2−K2), (Z2−K2)). Thus, after the second conversion is performed for the pixel A and the pixel B, the second RGBW luminance values La and Lb of the pixel A and the pixel B are obtained respectively as follows:

$$L\ a=[(X1-K1-K)R,(Z1-K1-K/2)B,(K1+K/2)W];$$

$$Lb=[(Y2-K2-K)G,(Z2-K2-K/2)B,(K2+K/2)W].$$

FIG. 3 shows a schematic diagram of an effect achieved after performing a first conversion and a second conversion for an RGB luminance value according to an embodiment of the present disclosure. As shown in FIG. 3, the number of adjacent pixels is N=2 and the adjacent pixels are pixel A and pixel B, respectively. The RGB luminance values of the pixel A is (5R, 2G, 9B), that is, in the RGB luminance value of the pixel A, the R luminance value is 5, the G luminance value is 2, and the B luminance value is 9. The RGB luminance value of the pixel B is (2R, 4G, 5B), that is, in the RGB luminance value of the pixel B, the R luminance value is 2, the G luminance value is 4, and the B luminance value is 5.

An arrow (1) in FIG. 3 indicates that the first conversion is performed for the pixel A. Here, a first conversion amount of the pixel A is determined as the minimum value in the R, G, B luminance values of the pixel A, that is, the G luminance value 2. Therefore, the first conversion amount is subtracted from the R, G, and B luminance values, respectively, and the first conversion amount 2 is taken as the W luminance value, thereby converting the RGB luminance value of the pixel A into a first RGBW luminance value. The first RGBW luminance value of the pixel A obtained after the first conversion indicated by the arrow (1) is: 3R, 0G, 7B and 2W. Similarly, the arrow (2) indicates that the first conversion is performed for the pixel B, and the first RGBW luminance value of the pixel B after the first conversion shown by the arrow (2) is: 0R, 2G, 3B and 2W.

As is apparent from FIG. 3, the R, G, and B luminance values of the pixels A and B are significantly lowered after the first conversion. In addition, since the first conversion amount is the minimum value among the R luminance value, the G luminance value and the B luminance value, at least one luminance value of the RGB luminance values of the pixels A and B is zero after the first conversion. For example, as shown in FIG. 3, the G luminance value of the pixel A pointed by the arrow (1) is zero, and the R luminance value of the pixel B pointed by the arrow (2) is zero.

In the second conversion, the second conversion amount is determined by taking the pixel A and its adjacent one or more pixels as a whole. The second RGBW luminance value may be obtained by subtracting corresponding conversion amounts determined according to the second conversion amount from the R luminance value, the G luminance value and the B luminance value of the first RGBW luminance value of a respective pixel, respectively.

As described above, in the first RGBW luminance value of each pixel after the first conversion, at least one of the R, G, and B luminance values is zero. In this case, by taking adjacent N pixels into account as a whole, luminance values may be borrowed from each other between adjacent pixels through the second conversion. In this way, the R, G, and B luminance values may be further reduced while ensuring the display effect, and the grayscale value input when the display panel is lighted up may be further reduced. As such, the approaches according to the embodiments of the present disclosure may substantially slow down the aging of sub-pixels and prolong the service life of the display panel.

Again, the adjacent pixel A and pixel B in FIG. 3 are taken as an example. In the figure, the arrow (3) indicates that the second conversion is performed with considering the pixel A and the pixel B as a whole. Since a maximum value of the second conversion amount is a minimum value in the sum 3 of the R luminance values, the sum 2 of the G luminance values and the sum 10 of the B luminance values of the first RGBW luminance values of the pixels, the maximum value of the second conversion amount in the arrow (3) is 2. In the figure, by way of example, the second conversion amount is illustrated as being determined to be its maximum value. Since the R luminance value in the first RGBW luminance value of the pixel B is zero, the pixel B may borrow the R luminance value in the pixel A, that is, the R luminance value of pixel A is subtracted by 2. Similarly, the G luminance value in the first RGBW luminance values in the pixel A is zero, and thus the G luminance value of the pixel B is subtracted by 2. Since the B luminance values in the first RGBW luminance values of the pixel A and the pixel B are not zero, the B luminance value of the pixel A is subtracted by 1, and the B luminance value of the pixel B is subtracted by 1, so that the sum of the B luminance values is subtracted by a total of two. Thereafter, the second conversion amount is added to a sum of W luminance values. In order to ensure the display uniformity, the obtained sum of W luminance values is evenly distributed to the pixel A and the pixel B, that is, the W luminance values in the pixel A and the pixel B are respectively increased by 1, to obtain the second RGBW luminance value of the pixel A and of pixel B. Thus, the second RGBW luminance value of the pixel A pointed by the arrow (3) is: 1R, 0G, 6B and 3W, and the second RGBW luminance value of the pixels B is: 0R, 0G, 2B and 3W. By comparing the luminance values before and after the arrow (3), it can be seen that the R, G, and B luminance values are further lowered, and the W luminance value is further increased.

In some embodiments, a premise of the first conversion may be that any one of the R luminance value, the G luminance value and the B luminance value of each pixel of each image frame is not zero. A premise of the second conversion may be that in the first RGBW luminance values of the N adjacent pixels, the R luminance values are not zero at the same time, the G luminance values are not zero at the same time, and the B luminance values are not zero at the same time. That is, any one of the sum of the R luminance values, the sum of the G luminance values and the sum of the B luminance values of respective first RGBW luminance values is not zero.

Optionally, in the second conversion, subtracting the second conversion amount from the sum of the R luminance values, the sum of the G luminance values and the sum of the B luminance values, respectively may comprise: for first RGBW luminance values corresponding to the N pixels, in the first RGBW luminance values having non-zero R luminance values, the conversion amount subtracted from the R luminance values is equal; in the first RGBW luminance values having non-zero G luminance values, the conversion amount subtracted from the G luminance values is equal; in the first RGBW luminance values having non-zero B luminance values, the conversion amount subtracted from the B luminance values is equal.

Optionally, in the second conversion, adjacent N pixels are converted as a whole. When the second conversion amount is subtracted from the sum of the R luminance values, if the R luminance values in the N pixels are not zero, an equal corresponding conversion amount is subtracted from an R luminance value in each pixel, and the sum of conversion amounts subtracted from the R luminance values in the N pixels is the second conversion amount. As such, the display uniformity of the display panel may be ensured. If there is a pixel(s) having zero R luminance value among the N pixels, an equal corresponding conversion amount is subtracted from non-zero R luminance values of the first RGBW luminance values of the pixels in the second conversion. This may also ensure the display uniformity.

In an embodiment, when, among the N pixels, the number of pixels of which the first RGBW luminance values have non-zero R luminance values is $n_R$, a corresponding conversion amount subtracted from an R luminance value is $1/n_R$ of the second conversion amount, where $n_R \leq N$. When, among the N pixels, the number of pixels of which the first RGBW luminance values have non-zero G luminance values is $n_G$, a corresponding conversion amount subtracted from a G luminance value is $1/n_G$ of the second conversion amount, where $n_G \leq N$. When, among the N pixels, the number of pixels of which the first RGBW luminance values have non-zero B luminance values is $n_B$, a corresponding conversion amount subtracted from a B luminance value is $1/n_B$ of the second conversion amount, where $n_B \leq N$.

For example, an example is taken in which N=3 and the second conversion amount is 3. If the R luminance values of the three pixels are not zero, the corresponding conversion amount is ⅓ of the second conversion amount 3, that is, the R luminance value of each pixel is subtracted by 1; if there are two pixels whose R luminance values are not zero, the corresponding conversion amount is ½ of the second conversion amount 3, that is, the R luminance values of the two pixels are subtracted by 1.5; if there is one pixel whose R luminance value is not zero, the corresponding conversion amount is the second conversion amount 3, that is, the R luminance value of the one pixel is subtracted by 3.

It may be appreciated that all of the possibilities discussed above for the R luminance value are also applicable for the G luminance value and the B luminance value.

It may be appreciated that determination of corresponding conversion amounts described above is exemplary. The corresponding conversion amounts for R luminance values, G luminance values and B luminance values corresponding to respective RGBW values may also be determined based on the second conversion amount in other manners (e.g., in different proportions).

It may be appreciated that for other cases where adjacent pixels are otherwise determined, the second RGBW luminance value may be determined in a similar manner. An example is taken in which the layout of adjacent pixels is as shown in FIG. 2*c*, that is, five pixels adjacent to each other are selected. If the R luminance values in n ($n \leq 5$) pixels are not zero, an R luminance value in a second RGBW luminance value of a respective pixel after conversion may be calculated to be equal to an R luminance value in a first RGBW luminance values minus 1/n of the second conversion amount. A G luminance value and a B luminance value in the second RGBW luminance value of the respective pixel may be calculated in the same manner. A W luminance value in the second RGBW luminance value of the respective pixel is equal to the W luminance value in the first RGBW luminance value plus one fifth of the second conversion amount.

It may be appreciated that the possibilities discussed above are also applicable for N taking other values.

In some embodiments, in the second conversion, the second conversion amount may be selected in a different manner. In one scenario, the second conversion amount may be selected to be equal to a minimum value among the R luminance values, the G luminance values and the B luminance values of the first RGBW luminance values of respective pixels of the N pixels. In such a scenario, the second conversion may be performed only once. Since the second conversion is performed only once, the amount of calculation required is small and the processing speed is fast.

In another scenario, the second conversion amount may be selected to be less than a minimum value among the R luminance values, the G luminance values and the B luminance values of the first RGBW luminance values of respective pixels of the N pixels. In such a scenario, the second conversion may be performed at least twice until the obtained minimum value among the sum of the R luminance values, the sum of the G luminance values and the sum of the B luminance values of the second RGBW luminance values of the N pixels is zero. Optionally, the sum of the second conversion amounts in at least two times of second conversion is a minimum value among the R luminance values, the G luminance values and the B luminance values of the first RGBW luminance values. Thus, there is no need to determine a specific value for a second conversion amount before performing a second conversion, thereby reducing the calculation amount of the second conversion.

The method for converting RGB image signals into RGBW image signals according to embodiments of the present disclosure alleviates a problem in the prior art that the aging of sub-pixels affects the display effect and the service life.

The embodiments according to the present disclosure have been described above with reference to operation examples of the method. In this regard, various blocks in the figures may represent a module, a code segment, or a code portion that comprises one or more executable instructions for implementing (a plurality of) specified logical function(s). It should be understood that various blocks of the operation examples and combinations thereof may be implemented by analog and/or digital m hardware and/or program instructions. These program instructions may be provided to a controller (which may comprise one or more general-purpose processors, special-purpose processors, ASICs, and/or other programmable data processing devices) such that an apparatus for implementing the functions/acts designed by the blocks may be created via these instructions executed by the controller and/or other programmable data processing devices. In some alternative implementations, the functions/acts shown in the blocks may not be performed in the order shown in the operation examples. For example, two blocks shown in succession might be executed substantially concurrently, or the blocks may be executed in a reverse order sometimes, depending on the function/acts involved.

FIG. 4 is a structural schematic diagram of an apparatus for converting RGB image signals into RGBW image signals according to an embodiment of the present disclosure. As shown in FIG. 4, the apparatus comprises a luminance value determiner 201, a converter unit 202, and a signal determiner 203.

The luminance value determiner 201 is configured to RGB image signals of pixels of each received image frame into corresponding RGB luminance values respectively.

The converter unit 202 is configured to perform conversion from an RGB luminance value to an RGBW luminance value for each pixel. The converter unit 202 comprises a first converter 2021 and a second converter 2022.

The first converter 2021 is configured to perform a first conversion to the RGBW luminance value by determining a first conversion amount based on the corresponding RGB luminance value of the pixel to obtain the first RGBW luminance value of the pixel. In an embodiment, the first converter 2021 may perform the first conversion for the RGB luminance value of the pixel by: subtracting the first conversion amount respectively from an R luminance value, a G luminance value and a B luminance value of the RGB luminance value of the pixel, and taking the first conversion amount as a W luminance value, in order to obtain the first RGBW luminance value; the first conversion amount is a minimum value among the R luminance value, the G luminance value and the B luminance value of the RGB luminance value.

The second converter 2022 is configured to perform a second conversion to the RGBW luminance value by determining a second conversion amount based on the first RGBW luminance values of the pixel and its adjacent one or more pixels in order to obtain the second RGBW luminance value of the pixel. In an embodiment, the second converter 2022 may perform the second conversion for the first RGBW luminance value of the pixel by: subtracting the second conversion amount respectively from a sum of the R luminance values, a sum of the G luminance values and a sum of the B luminance values of the first RGBW luminance values of the N pixels, and adding a ratio of the second conversion amount to N to the W luminance value, to obtain the second RGBW luminance value; the second conversion amount is not greater than a minimum value among the sum of the R luminance values, the sum of the G luminance values and the sum of the B luminance values of the first RGBW luminance values of the pixels in the N pixels; $N \geq 2$.

The signal determiner 203 is configured to convert the second RGBW luminance values of the pixels of each image frame into corresponding RGBW image signals.

In some embodiments, the second converter 2022 is configured in a way that for first RGBW luminance values corresponding to N pixel, in the first RGBW luminance values that have non-zero R luminance values, corresponding conversion amounts subtracted from the R luminance values are equal; in the first RGBW luminance values that have non-zero G luminance values, corresponding conversion amounts subtracted from the G luminance values are equal; in the first RGBW luminance values that have non-zero B luminance values, corresponding conversion amounts subtracted from the B luminance values are equal.

In some embodiments, the second converter 2022 is configured to select adjacent pixels of a current pixel in different ways. Exemplarily, when N=2, the pixel and a pixel closest to the pixel in a row direction or a column direction are taken as the N adjacent pixels; when N=5, the pixel and four pixels closest to the pixel in a row direction and a column direction are taken as the N adjacent pixels; when N=9, the pixel and four pixels closest to the pixel in a row direction and a column direction, and four pixels closest to the pixel in a diagonal direction are taken as the N adjacent pixels.

Optionally, the second converter 2022 is configured to perform the second conversion once when the second conversion amount is equal to a minimum value among a sum of R luminance values, a sum of G luminance values and a sum of B luminance value of the first RGBW luminance values of respective ones of the N pixels.

Optionally, the second converter 2022 is configured to perform the second conversion at least twice when the second conversion amount is smaller than a minimum value among a sum of R luminance values, a sum of G luminance values and a sum of B luminance value of the first RGBW luminance values of respective ones of the N pixels, until an obtained minimum value among the sum of the R luminance values, the sum of the G luminance values and the sum of the B luminance values of the second RGBW luminance values of the N pixels is zero.

It may be appreciated that embodiments of the apparatus correspond to embodiments of the method described above, and that all possibilities discussed with respect to FIG. 1 to FIG. 3 are also applicable for FIG. 4.

According to the conversion method and apparatus provided by the embodiments of the present disclosure, after RGB luminance values of pixels of each image frame are converted into RGBW values according to a relevant technology, the RGBW values of two or more adjacent pixels are considered as a whole so as to perform a conversion to RGBW values again. This further reduces the probability of lighting sub-pixels with high grayscale compared to related techniques in the prior art. At the same time, since a characteristic of human eyes that superimposes pixels in overall picture is utilized, the display effect of the picture may still be guaranteed. Therefore, the approaches according to embodiments of the present disclosure further slow down the aging of sub-pixels and prolong the service life of a display panel.

The present disclosure may be embodied as a method, an electronic device, and/or a computer program product. Accordingly, the present disclosure may be implemented by hardware (e.g., controller circuitry or instruction-executing systems) and/or software (including firmware, resident software, microcode, etc.). In the text, these hardware and software are commonly referred to as "units" or "modules". Furthermore, the present disclosure may take the form of a computer program product on a computer-usable or computer-readable medium, the computer program product having a computer-usable or computer-readable program code embodied in the medium for use by or for use together with an instruction-executing system. In the context of the present application, the computer-usable or computer-readable medium may be any non-transitory medium that may electronically/magnetically/optically comprise a program for use by or for use together with the instruction-executing system, apparatus, controller or device.

The words "comprise" or "comprising" used herein are open-ended, and comprise one or more said features, members, elements, steps, components or functions, and do not exclude existence or addition of one or more other features, members, elements, steps, components or functions and/or their combinations. The wording "and/or" used herein comprises any and all combinations of any one or more of the relevant listed items.

The terminology used herein is only used to illustrate a special implementation mode and not to limit the present disclosure. Otherwise unless specified, singular forms "a", "the" and "said" used in the text are intended to comprise plural forms.

It is apparent that those skilled in the art may make various changes and modifications to the present disclosure without departing from the spirit and scope of the present disclosure. As such, if these modifications and variations of the present disclosure fall within the scope of claims of the present disclosure or the scope of its equivalent technologies, the present disclosure is intended to comprise these modifications and variations.

The invention claimed is:

1. A method for converting RGB image signals into RGBW image signals, comprising:

converting RGB image signals of pixels of each received image frame into corresponding RGB luminance values respectively;

performing a conversion from an RGB luminance value to an RGBW luminance value for each pixel, by performing operations comprising:

performing a first conversion to the RGBW luminance value by determining a first conversion amount based on a corresponding RGB luminance value of the pixel to obtain a first RGBW luminance value of the pixel; and performing a second conversion to the RGBW luminance value by determining a second conversion amount based on the first RGBW luminance value of the pixel and its adjacent one or more pixels to obtain a second RGBW luminance value of the pixel; and converting respective second RGBW luminance values of the pixels of the image frame into corresponding RGBW image signals respectively;

wherein the performing the second conversion comprises:

grouping the pixel and one or more adjacent pixels into a group comprising N pixels; and subtracting, from respective R luminance values, respective G luminance values and respective B luminance values of the first RGBW luminance values of pixels in the group corresponding conversion amounts, wherein said corresponding conversion amounts are determined according to the second conversion amount respectively, so that the second conversion amount is subtracted respectively from a sum of the R luminance values, a sum of the G luminance values and a sum of the B luminance values of the first RGBW luminance values of the N pixels, and a ratio of the second conversion amount to N is added to the W luminance values, to obtain the respective second RGBW luminance values of respective pixels, and wherein the second conversion amount is not greater than a minimum value among the sum of the R luminance values, the sum of the G luminance values and the sum of the B luminance values of the first RGBW luminance values of the N pixels, wherein $N \geq 2$.

2. The method according to claim 1, wherein the performing the first conversion comprises:

subtracting the first conversion amount respectively from an R luminance value, a G luminance value and a B luminance value of the corresponding RGB luminance value of the pixel; and taking the first conversion amount as a W luminance value to obtain the first RGBW luminance value of the pixel, wherein the first conversion amount is determined as a minimum value among the R luminance value, the G luminance value and the B luminance value of the corresponding RGB luminance value.

3. The method according to claim 1, wherein the second conversion is performed when none of the sum of the R luminance values, the sum of the G luminance values and the sum of the B luminance values of the first RGBW luminance values of the N pixels is zero.

4. The method according to claim 3, wherein the corresponding conversion amounts are determined as follows:

when, among the N pixels, a number of pixels that each has a non-zero R luminance value in a respective first RGBW luminance value is $n_R$, then a corresponding conversion amount subtracted from an R luminance value is $1/n_R$ of the second conversion amount, where $n_R \leq N$;

when, among the N pixels, a number of pixels that each has a non-zero G luminance value in a respective first RGBW luminance value is $n_G$, then a corresponding conversion amount subtracted from a G luminance value is $1/n_G$ of the second conversion amount, where $n_G \leq N$; and when, among the N pixels, a number of pixels that each has a non-zero B luminance value in a respective first RGBW luminance value is $n_B$, then a corresponding conversion amount subtracted from a B luminance value is $1/n_B$ of the second conversion amount, where $n_B \leq N$.

5. The method according to claim 3, wherein the N pixels are determined for a current pixel as follows:

when N=2, the N pixels comprise the current pixel and a pixel closest to the current pixel in a row direction or a column direction;

when N=5, the N pixels comprise the current pixel and four pixels closest to the current pixel in a row direction and a column direction; and when N=9, the N pixels comprise the current pixel, four pixels closest to the current pixel in a row direction and a column direction, and four pixels closest to the current pixel in a diagonal direction.

6. The method according to claim 3, wherein the performing the second conversion comprises:

performing the second conversion once when the second conversion amount is equal to a minimum value among the sum of R luminance values, the sum of G luminance values and the sum of B luminance values of the first RGBW luminance values of respective ones of the N pixels; and performing the second conversion at least twice when the second conversion amount is smaller than a minimum value among the sum of R luminance values, the sum of G luminance values and the sum of B luminance values of the first RGBW luminance values of respective ones of the N pixels, until an obtained minimum value among the sum of the R luminance values, the sum of the G luminance values and the sum of the B luminance values of the second RGBW luminance values of the N pixels is zero.

7. The method according to claim 1, wherein the corresponding conversion amounts are determined as follows:

when, among the N pixels, a number of pixels that each has a non-zero R luminance value in a respective first RGBW luminance value is $n_R$, then a corresponding conversion amount subtracted from an R luminance value is $1/n_R$ of the second conversion amount, where $n_R \leq N$;

when, among the N pixels, a number of pixels that each has a non-zero G luminance value in a respective first RGBW luminance value is $n_G$, then a corresponding conversion amount subtracted from a G luminance value is $1/n_G$ of the second conversion amount, where $n_G \leq N$; and when, among the N pixels, a number of pixels that each has a non-zero B luminance value in a respective first RGBW luminance value is $n_B$, then a corresponding conversion amount subtracted from a B luminance value is $1/n_B$ of the second conversion amount, where $n_B \leq N$.

8. The method according to claim 7, wherein the performing the second conversion comprises:

performing the second conversion once when the second conversion amount is equal to a minimum value among the sum of R luminance values, the sum of G luminance values and the sum of B luminance values of the first RGBW luminance values of respective ones of the N pixels; and performing the second conversion at least twice when the second conversion amount is smaller than a minimum value among the sum of R luminance values, the sum of G luminance values and the sum of B luminance values of the first RGBW luminance values of respective ones of the N pixels, until an obtained minimum value among the sum of the R luminance values, the sum of the G luminance values and the sum of the B luminance values of the second RGBW luminance values of the N pixels is zero.

9. The method according to claim 1, wherein the N pixels are determined for a current pixel as follows:

when N=2, the N pixels comprise the current pixel and a pixel closest to the current pixel in a row direction or a column direction;

when N=5, the N pixels comprise the current pixel and four pixels closest to the current pixel in a row direction and a column direction; and when N=9, the N pixels comprise the current pixel, four pixels closest to the current pixel in a row direction and a column direction, and four pixels closest to the current pixel in a diagonal direction.

10. The method according to claim 1, wherein the performing the second conversion comprises:

performing the second conversion once when the second conversion amount is equal to a minimum value among the sum of R luminance values, the sum of G luminance values and the sum of B luminance values of the first RGBW luminance values of respective ones of the N pixels; and performing the second conversion at least twice when the second conversion amount is smaller than a minimum value among the sum of R luminance values, the sum of G luminance values and the sum of B luminance values of the first RGBW luminance values of respective ones of the N pixels, until an obtained minimum value among the sum of the R luminance values, the sum of the G luminance values and the sum of the B luminance values of the second RGBW luminance values of the N pixels is zero.

11. A computing device, comprising:

one or more processors; and a computer readable storage medium having stored thereon a plurality of instructions which, responsive to being executed by the one or more processors, cause the one or more processors to perform the method according to claim 1.

12. An apparatus for converting RGB image signals into RGBW image signals, comprising:

a luminance value determiner configured to convert RGB image signals of pixels of each received image frame into corresponding RGB luminance values respectively;

a converter unit configured to perform a conversion from an RGB luminance value to an RGBW luminance value for each pixel, and comprising:

a first converter configured to perform a first conversion to an RGBW luminance value by determining a first conversion amount based on a corresponding RGB luminance value of the pixel to obtain a first RGBW luminance value of the pixel; and a second converter configured to perform a second conversion to the RGBW luminance value by determining a second conversion amount based on the first RGBW luminance value of the pixel and its adjacent one or more pixels to obtain a second RGBW luminance value of the pixel; and a signal determiner configured to convert respective second RGBW luminance values of the pixels of the image frame into corresponding RGBW image signals respectively, wherein the second converter is configured to group the pixel and its adjacent pixels into a group comprising N pixels, and subtract, from the R luminance values, G luminance values and B luminance values of the first RGBW luminance values of pixels in the group corresponding conversion amounts, wherein said corresponding conversion amounts are determined according to the second conversion amount respectively, so that the second conversion amount is subtracted respectively from a sum of the R luminance values, a sum of the G luminance values and a sum of the B luminance values of the first RGBW luminance values of the N pixels, and a ratio of the second conversion amount to N is added to the W luminance value, to obtain the respective second RGBW luminance values of the respective pixels, wherein the second conversion amount is not greater than a minimum value among the sum of the R luminance values, the sum of the G luminance values and the sum of the B luminance values of the first RGBW luminance values of the N pixels, and wherein $N \geq 2$.

13. The apparatus according to claim 12, wherein the first converter is configured to subtract the first conversion amount respectively from an R luminance value, a G luminance value and a B luminance value of the RGB luminance value of the pixel, and take the first conversion amount as a W luminance value, to obtain the first RGBW luminance value of the pixel, wherein the first conversion amount is a minimum value among the R luminance value, the G luminance value and the B luminance value of the RGB luminance value.

14. The apparatus according to claim 13, wherein the second converter is configured to determine the corresponding conversion amounts as follows:

when, among the N pixels, a number of pixels that each has a non-zero R luminance value in a respective first RGBW luminance value is $n_R$, then a corresponding conversion amount subtracted from an R luminance value is $1/n_R$ of the second conversion amount, where $n_R \leq N$;

when, among the N pixels, a number of pixels that have non-zero G luminance value in respective the first RGBW luminance values is $n_G$, then a corresponding conversion amount subtracted from a G luminance value is $1/n_G$ of the second conversion amount, where $n_G \leq N$; and when, among the N pixels, a number of pixels that have non-zero B luminance value in respective the first RGBW luminance values is $n_B$, then a corresponding conversion amount subtracted from a B luminance value is $1/n_B$ of the second conversion amount, where $n_B \leq N$.

15. The apparatus according to claim 12, wherein the second converter is configured to perform the second conversion when none of the sum of the R luminance values, the sum of the G luminance values and the sum of the B luminance values of the first RGBW luminance values of the N pixels is zero.

16. The apparatus according to claim 15, wherein the second converter is configured to determine the N pixels for a current pixel as follows:

when N=2, the N pixels comprise the current pixel and a pixel closest to the current pixel in a row direction or a column direction;

when N=5, the N pixels comprise the current pixel and four pixels closest to the current pixel in a row direction and a column direction; and when N=9, the N pixels comprise the current pixel, four pixels closest to the current pixel in a row direction and a column direction, and four pixels closest to the current pixel in a diagonal direction.

17. The apparatus according to claim 15, wherein the second converter is configured to perform the second conversion once when the second conversion amount is equal to a minimum value among the sum of R luminance values, the sum of G luminance values and the sum of B luminance values of the first RGBW luminance values of respective ones of the N pixels; and wherein the second converter is further configured to perform the second conversion at least twice when the second conversion amount is smaller than a minimum value among the sum of R luminance values, the sum of G luminance values and the sum of B luminance values of the first RGBW luminance values of respective ones of the N pixels, until an obtained minimum value among the sum of the R luminance values, the sum of the G luminance values and the sum of the B luminance values of the second RGBW luminance values of the N pixels is zero.

18. The apparatus according to claim 12, wherein the second converter is configured to determine the corresponding conversion amounts as follows:

when, among the N pixels, a number of pixels that each has a non-zero R luminance value in a respective first RGBW luminance value is $n_R$, then a corresponding conversion amount subtracted from an R luminance value is $1/n_R$ of the second conversion amount, where $n_R \leq N$;

when, among the N pixels, a number of pixels that have non-zero G luminance value in respective the first RGBW luminance values is $n_G$, then a corresponding conversion amount subtracted from a G luminance value is $1/n_G$ of the second conversion amount, where $n_G \leq N$; and when, among the N pixels, a number of pixels that have non-zero B luminance value in respective the first RGBW luminance values is $n_B$, then a corresponding conversion amount subtracted from a B luminance value is $1/n_B$ of the second conversion amount, where $n_B \leq N$.

19. The apparatus according to claim 12, wherein the second converter is configured to determine the N pixels for a current pixel as follows:

when N=2, the N pixels comprise the current pixel and a pixel closest to the current pixel in a row direction or a column direction;

when N=5, the N pixels comprise the current pixel and four pixels closest to the current pixel in a row direction and a column direction; and when N=9, the N pixels comprise the current pixel, four pixels closest to the current pixel in a row direction and a column direction, and four pixels closest to the current pixel in a diagonal direction.

20. The apparatus according to claim 12, wherein the second converter is configured to perform the second conversion once when the second conversion amount is equal to a minimum value among the sum of R luminance values, the sum of G luminance values and the sum of B luminance values of the first RGBW luminance values of respective ones of the N pixels; and wherein the second converter is further configured to perform the second conversion at least twice when the second conversion amount is smaller than a minimum value among the sum of R luminance values, the sum of G luminance values and the sum of B luminance values of the first RGBW luminance values of respective ones of the N pixels, until an obtained minimum value among the sum of the R luminance values, the sum of the G luminance values and the sum of the B luminance values of the second RGBW luminance values of the N pixels is zero.

* * * * *